United States Patent [19]

Failor et al.

[11] Patent Number: 4,489,449

[45] Date of Patent: Dec. 25, 1984

[54] TRAUMA CARE WHEELED STRETCHER

[75] Inventors: Raymond A. Failor, Chippewa Lake; Otto Z. Kabdebo, Medina, both of Ohio

[73] Assignee: Simmons Universal Corporation, New York, N.Y.

[21] Appl. No.: 232,120

[22] Filed: Feb. 6, 1981

[51] Int. Cl.[3] ..... A61G 7/10

[52] U.S. Cl. ..... 5/86; 5/66; 5/68; 5/62; 5/63

[58] Field of Search ..... 5/60, 63, 78, 86, 61, 5/62, 64–69; 296/20

[56] References Cited

U.S. PATENT DOCUMENTS

| | | | |
|---|---|---|---|
| 1,626,091 | 4/1927 | Macklin | 5/66 |
| 2,217,783 | 10/1940 | Bell | 5/60 |
| 2,632,898 | 3/1953 | Pardoe | 5/66 |
| 2,819,475 | 1/1958 | Ericsson | 5/78 |
| 3,304,116 | 2/1967 | Stryker | 5/86 X |
| 3,317,931 | 5/1967 | Benoit et al. | 5/63 X |
| 3,579,671 | 5/1971 | Kotter | 5/63 X |
| 3,733,623 | 5/1973 | Croxton | 5/63 |
| 3,739,406 | 6/1973 | Koetter | 5/62 |
| 3,742,527 | 7/1973 | Johnston et al. | 5/63 |
| 3,814,414 | 6/1974 | Chapa | 5/60 X |
| 3,827,089 | 8/1974 | Grow | 5/61 |
| 4,002,330 | 1/1977 | Johansson | 5/60 X |
| 4,023,849 | 5/1977 | Bethlen | 296/20 |
| 4,097,941 | 7/1978 | Merkel | 5/63 X |
| 4,231,124 | 11/1980 | Croxton | 5/62 |

FOREIGN PATENT DOCUMENTS

| | | | |
|---|---|---|---|
| 2525596 | 12/1976 | Fed. Rep. of Germany | 5/67 |
| 570802 | 12/1975 | Switzerland | 5/60 R |
| 1274324 | 5/1972 | United Kingdom | 5/63 |

*Primary Examiner*—Alexander Grosz
*Assistant Examiner*—Michael F. Trettel
*Attorney, Agent, or Firm*—Bell, Seltzer, Park & Gibson

[57] ABSTRACT

The patient supporting platform of the present stretcher is supported above an undercarriage by hydraulic lift cylinders to be raised or lowered and tilted into head-up or head-down positions. A backrest is provided on the patient supporting platform and may be inclined at various angles so that the position of the patient supporting platform can be adjusted throughout a wide range of adjusted positions. Foot operated brake levers are provided at each side of the stretcher for at times locking the wheels. Duplicate controls for carrying out the various adjustments of the stretcher, and for controlling the brakes, are provided on each side of the stretcher so that an attendant positioned at either side of the stretcher may immediately make any necessary adjustments of the stretcher while continuously monitoring the condition of the patient.

4 Claims, 7 Drawing Figures

TRAUMA CARE WHEELED STRETCHER

FIELD OF THE INVENTION

This invention relates generally to a wheeled stretcher with an adjustable patient supporting platform and more particularly to such a stretcher with duplicate adjustment controls positioned on each side of the patient supporting platform so that an attendant may adjust the position of the patient supporting platform without leaving the side of a patient on the stretcher.

BACKGROUND OF THE INVENTION

It is generally known to provide a wheeled stretcher, sometimes referred to as a Gurney, which is used in the trauma care of patients and this type of stretcher may function as a transport vehicle, an examining table, and/or an operating table. The patient supporting platform of this type of stretcher is usually adjustable in a vertical direction and may be tilted to a head-down (Trendlenburg) or a head-up (reverse Trendlenburg) position by hydraulic cylinders actuated by means of a foot pedal operated pumping device. Brake means is also provided to lock the wheels when the stretcher is not being used to transport the patient. In some instances, the stretcher is also provided with a pivotally supported backrest with control means for varying the adjusted (Fowler) position of the backrest. Examples of this well known type of stretcher are disclosed in U.S. Pat. Nos. 4,175,783; 3,820,838; 3,393,004; 3,341,246; and 3,050,745.

With many patients, it is critical that the condition of the patient be continuously monitored by an attendant remaining alongside the patient at one side or the other. In some instances, such monitoring reveals signs evidencing an immediate need for a change in the position of the patient to either a heads-down shock position or head-up drainage position.

In the above-mentioned patents, continuous monitoring of the patient's condition while adjusting the patient supporting platform is not possible since the controls for adjusting the patient supporting platform and applying the brakes to the wheels are positioned at the ends of the stretcher so that it is necessary for the attendant to leave the side of the patient and to move to either end of the stretcher in order to make the required adjustment of the patient supporting platform and/or to apply the brakes to the wheels of the stretcher. In some cases, the control end of the stretcher may be positioned against a wall and it is then necessary to pull the stretcher away from the wall before the attendant can operate the controls causing even further delay interruption in the monitoring of the condition of the patient. In some extreme cases, the failure of the attendant to remain constantly attentive at the side of the patient may be critical to the health of the patient.

SUMMARY OF THE INVENTION

With the foregoing in mind, it is an object of the present invention to provide a trauma care stretcher, wherein the condition of the patient may be continuously monitored by an attendant who also can adjust the position of the patient supporting platform, patient Fowler backrest, and/or apply the brake to the wheeled stretcher without leaving the patient's side or interrupting the monitoring of the patient's condition.

In accordance with the present invention, a foot pedal hydraulic pumping lever is positioned at each side of the stretcher for operating hydraulic cylinders for raising the patient supporting platform. A foot operated brake pedal is positioned at each side of the undercarriage of the stretcher and is operable to apply the brakes to the wheels of the stretcher by an attendant while positioned at either side of the stretcher. Control means is positioned at each side of the patient supporting platform and is operable by the attendant positioned at either side of the platform for selectively lowering and/or tilting the patient supporting platform, as required. Backrest controls are also provided at each side of the patient supporting platform so that the position of the patient may be varied by the attendant while remaining at the side of the stretcher. A gas spring is provided to aid in adjusting the backrest to various Fowler positions.

BRIEF DESCRIPTION OF THE DRAWINGS

Other objects and advantages will appear as the description proceeds when taken in connection with the accompanying drawings, in which—

DESCRIPTION OF THE ILLUSTRATED EMBODIMENT

Figure 1:
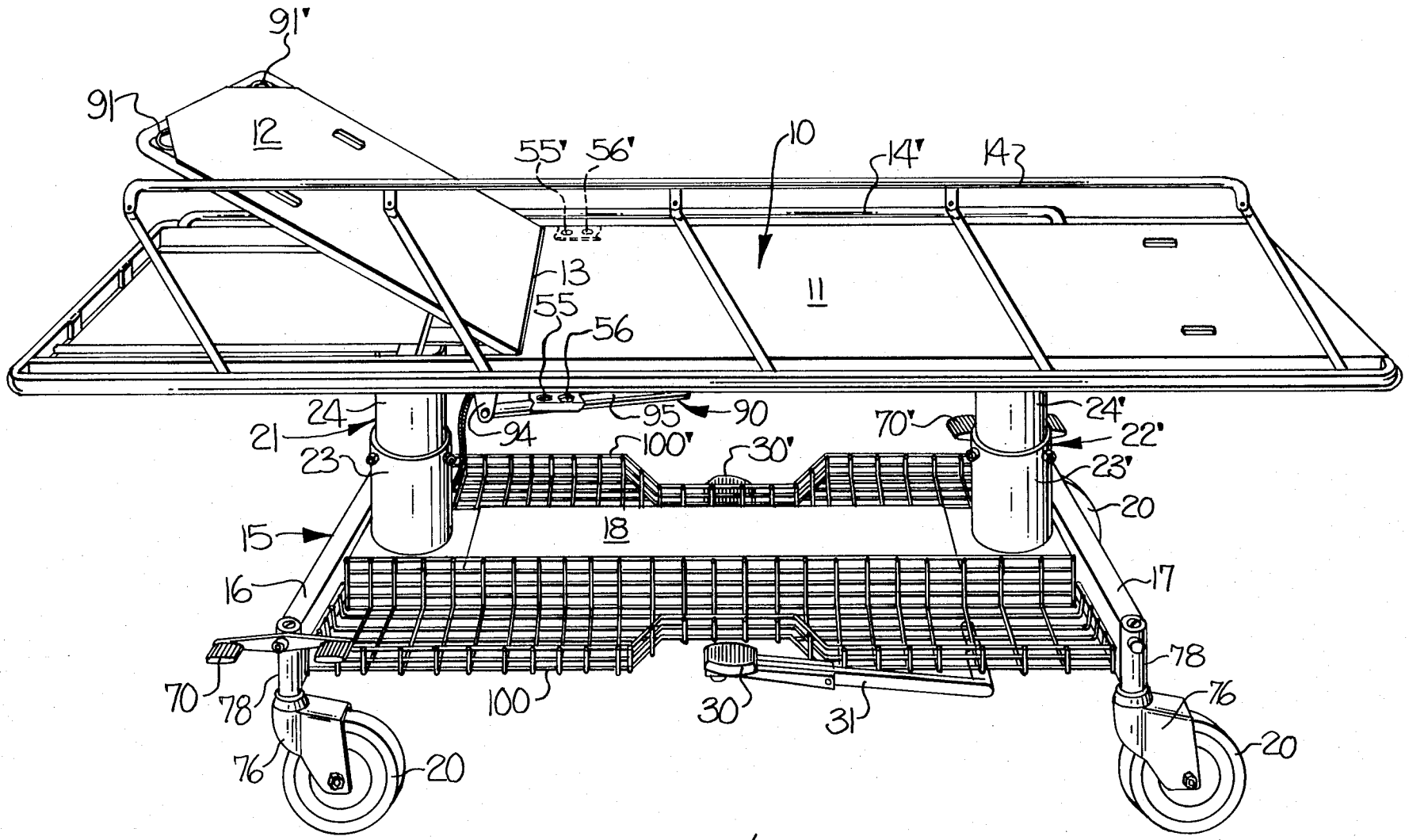
FIG. 1 is a perspective elevational view of one side of the stretcher of the present invention.

The trauma care wheeled stretcher of the present invention (FIG. 1) generally includes a rectangular patient supporting platform, broadly indicated at 10 and including head and foot ends and opposite sides. The patient supporting platform 10 includes a fixed body supporting portion 11 and a backrest portion 12 which is pivotally connected, as at 13, to one end of the fixed body portion 11 and is supported for angular adjustment, in a manner to be presently described. Self-storing side rails 14, 14' are supported at opposite sides of the platform 10 for movement between the raised position illustrated by rail 14 and the lowered position, illustrated by the rail 14'. A patient support pad or mattress, not shown, is normally provided on the upper surface of the platform 10 to provide a comfortable support for the patient.

An undercarriage structure, broadly indicated at 15, is positioned below the platform 10, is of generally the same width as the platform 10, and includes corresponding head and foot ends and opposite sides. The undercarriage structure 15 includes a head-end cross frame 16, a foot-end cross frame 17 and a central support frame 18 connected at opposite ends to the cross frames 16, 17. A caster wheel 20 is supported, in a manner to be presently described, at each corner of the undercarriage 15 so that the stretcher may be moved from place to place when it is necessary to transport the patient.

Figure 2:
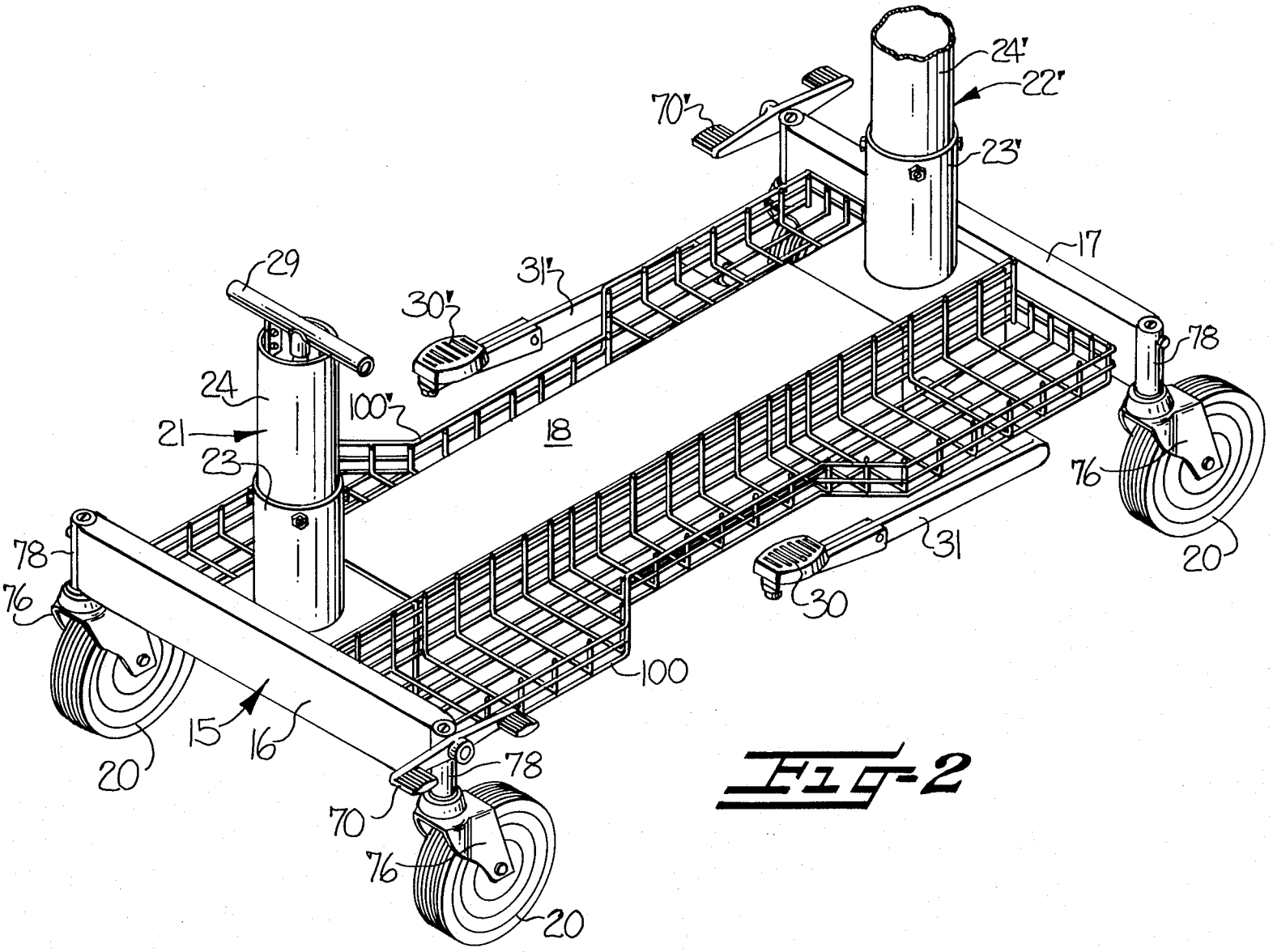
FIG. 2 is an isometric view of the undercarriage structure of the stretcher with the patient supporting platform removed.
Figure 5:
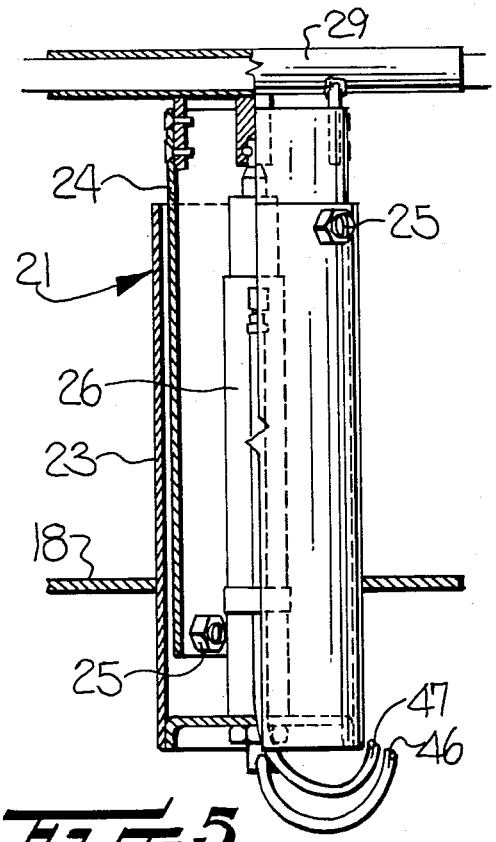
FIG. 5 is a vertical sectional view through one of the hydraulic lift cylinders supporting one end of the patient supporting platform.

Hydraulic means is carried by the undercarriage for supporting the patient supporting platform 10 for vertical movement relative to the undercarriage 15. The hydraulic means includes a head-end support column, broadly indicated at 21, and a foot-end support column, broadly indicated at 22, in FIGS. 1 and 2. The support columns 21, 22 are identical in construction and the details of the support column 21 will be described with reference to FIG. 5 while the corresponding parts of the support column 22 will bear the same reference numerals with the prime notation added.

The support column 21 (FIG. 5) includes an outer telescoping guide sleeve 23, the lower portion of which is fixed on the frame 18 and the upper portion of which supports an upper guide sleeve 24 for vertical sliding movement therein. Adjustable guide pins 25 are provided at the upper end of the guide sleeve 23 and the lower end of the guide sleeve 24 for guiding the vertical movement of the upper guide sleeve 24. A hydraulic cylinder 26 is supported at its lower end in the guide sleeve 23 and its upper end is connected to a support tube 29 which is, in turn, suitably connected to the head-end portion of the patient supporting platform 10.

Figure 3:
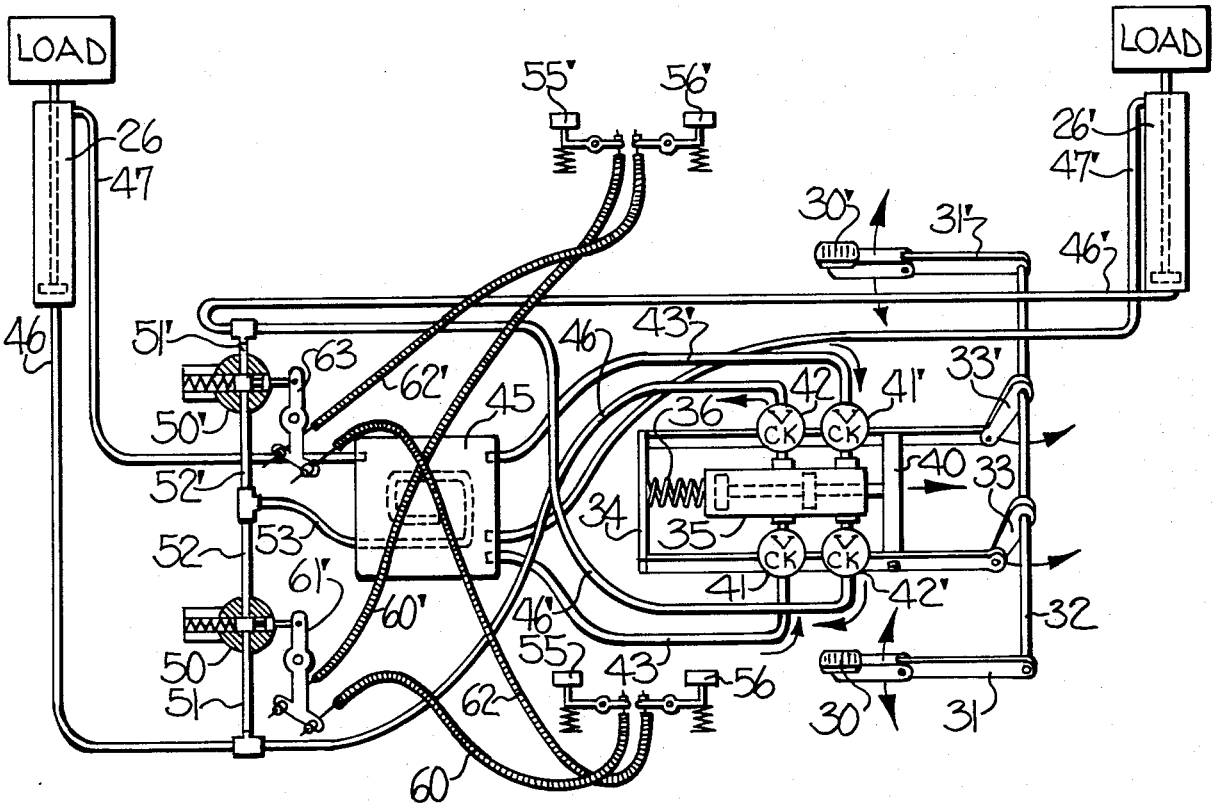
FIG. 3 is a somewhat schematic diagram illustrating the hydraulic system for controlling the vertical and tilting positions of the patient supporting platform.

Foot pedal hydraulic pumping means, including folding action foot pedals 30, 30' is positioned at each side of the undercarriage 15 for operation by an attendant positioned at either side of the patient supporting platform 10. The foot pedal hydraulic pumping means, best illustrated in FIG. 3, also includes operating levers 31, 31' connected at one end to the respective foot pedals 30, 30' and connected at their opposite ends to an operating shaft 32, pivotally supported intermediate its ends on the frame 18. Levers 33, 33' are fixed at their upper ends on the operating shaft 32 and are pivotally connected at their lower ends to a substantially U-shaped pump actuator 34 which surrounds a single shaft dual chamber hydraulic pump 35. A spring 36 normally urges the U-shaped pump actuator 34 to the left in FIG. 3 so that the foot pedals 30, 30' are normally maintained in a raised position.

A cross frame 40 is connected at opposite ends to the pump actuator 34 and the medial portion is connected to the operating rod of the hydraulic pump 35, for purposes to be presently described. One-way check valves 41, 42 and 41', 42' are provided at opposite sides of the pump 35. A hydraulic line 43 is connected at one end to the check valve 41 and its opposite end is connected to a reservoir 45 containing hydraulic fluid. A hydraulic line 43' is connected at one end to the check valve 41' and its opposite end is connected to the reservoir 45. A hydraulic line 46 is connected at one end to the check valve 42 and its other end is connected to the lower end of the hydraulic lift cylinder 26. A hydraulic line 46' is connected at one end to the check valve 42' and its other end is connected to the lower end of the lift hydraulic cylinder 26'. One end of a hydraulic line 47 is connected to the upper end of the lift cylinder 26 and the opposite end is connected to the reservoir 45. One end of a hydraulic line 47' is connected to the upper end of the lift cylinder 26' and the opposite end is connected to the reservoir 45.

A normally closed control valve 50 is provided for controlling the lowering of the lift cylinder 26 at the head-end of the stretcher and a normally closed control valve 50' is provided for controlling the lowering of the lift cylinder 26' at the foot-end of the stretcher. The control valve 50 is connected to the line 46 by a hydraulic line 51 and the valve 50' is connected to the line 46' by a hydraulic line 51'. Hydraulic lines 52, 52' are connected to the respective valves 50, 50' and are commonly joined to a return line 53 which is, in turn, connected to the reservoir 45.

Patient supporting platform lowering and tilting control means is positioned at each side of and below the level of the patient supporting platform 10 and is illustrated as Trendlenburg pushbutton control levers 55, 55' and reverse Trendlenburg pushbutton control levers 56, 56'. Control cables 60, 60' are connected at one end to the respective pushbutton control levers 55, 55' and their opposite ends are connected to a valve control toggle lever 61 for operation of the valve 50, in a manner to be presently described. Control cables 62, 62' are suitably connected at one end to the respective pushbutton levers 56, 56' and their other ends are connected to a valve control toggle lever 63 which operates the valve 50', in a manner to be presently described.

The patient supporting platform 10 can be raised by an attendant positioned at either side of the stretcher by merely placing the foot on the corresponding foot pedal 30, 30' and applying a pumping action so that the pump 35 simultaneously supplies hydraulic fluid under pressure through the lines 46, 46' and to the lower ends of the lift cylinders 26, 26' to extend the piston rods therein and lift the patient supporting platform 10 to the desired height. The patient supporting platform 10 can be immediately moved to a Trendlenburg position by the attendant while remaining at either side of the stretcher. To immediately move the patient supporting platform 10 to the Trendlenburg position, the attendant merely pushes the pushbutton lever 55 or 55' corresponding with the side of the stretcher on which the attendant is positioned and the corresponding control cable 60, 60' will move the valve 50 to the open position so that the head-end lift cylinder 26 is immediately lowered and the hydraulic fluid can flow back through the line 46, line 51, valve 50, line 52, line 53, and return to the reservoir 45. When the head-end of the platform 10 is lowered to the position desired, the attendant will merely release the corresponding pushbutton control 55 or 55' so that the valve 50 will immediately move back to the normally closed position and prevent further flow of the hydraulic fluid from the head-end lift cylinder 26 and to the reservoir 45.

The patient supporting platform 10 may be immediately tilted to the reverse Trendlenburg position by the attendant depressing the pushbutton lever 56, 56' on the side of the stretcher on which the attendant is positioned. Immediately upon depressing the pushbutton 56 or 56', the corresponding control cable 62 or 62' will operate the toggle lever 63 to move the valve 50' to the open position so that the foot-end lift cylinder 26' will be immediately lowered and as the hydraulic fluid can then flow back through the line 46', line 51', valve 50', line 52', line 53 and return to the reservoir 45.

In order to lower the patient supporting platform 10 in a level condition, the attendant will simultaneously depress the pushbuttons 55, 56 or 55', 56' at either side of the stretcher so that both of the normally closed valves 50, 50' are moved to the open position and the hydraulic fluid can flow from the lower ends of both lift cylinders 26 and 26' and return to the reservoir 45. As soon as the buttons 55, 56 or 55', 56' are released by the attendant, the valves 50, 50' are immediately moved to the closed position to stop the flow of hydraulic fluid from the lift cylinders 26, 26' and immediately stop the downward vertical movement of the patient supporting platform 10.

Figure 7:
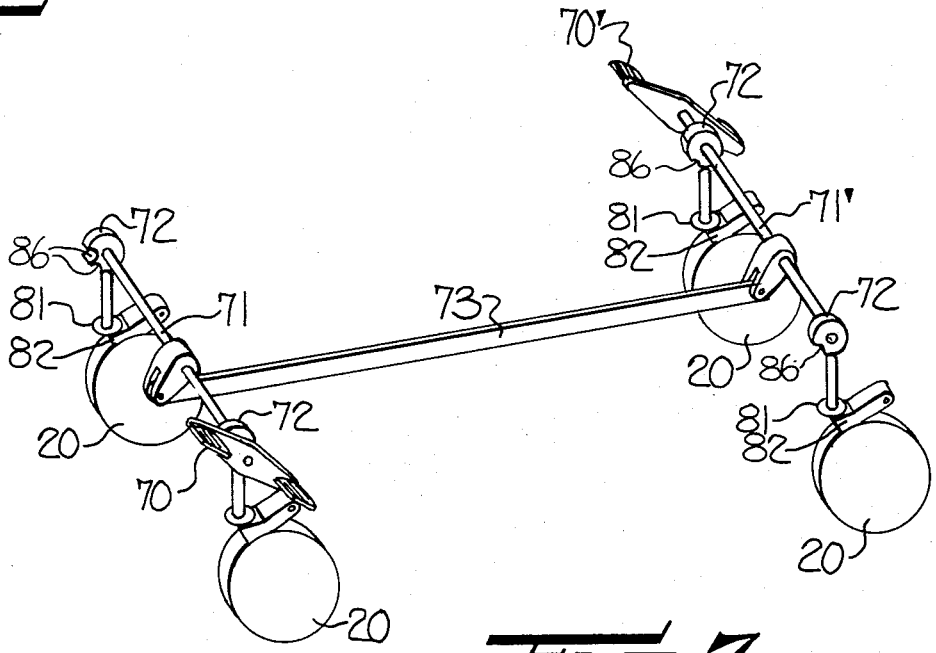
FIG. 7 is a somewhat schematic isometric view illustrating the manner in which the brake controls are operated and supported on each side of the stretcher.

Brake means is associated with each of the caster wheels 20 and includes a foot operated brake control 70, 70' positioned at each side of the undercarriage 15 so that the brake means can be applied to the caster wheels by an attendant positioned at either side of the patient supporting platform 10. The foot operated brake controls 70, 70' are fixed on the corresponding ends of respective control shafts 71, 71' (FIG. 7) which are supported for rotation in the corresponding cross frames 16, 17 of the undercarriage 15. Control cams 72 are provided on each end of each of the control shafts 71, 71' and operate the brake and swivel functions, in a manner to be presently described. An interconnect link 73 is connected at opposite ends to lever arms on the corresponding control shafts 71, 71' so that when one of the foot operated brake controls 70, 70' is operated to impart corresponding rotation to one of the control shafts 71, 71', the corresponding control shaft will be rotated in the same identical manner.

Figure 6:
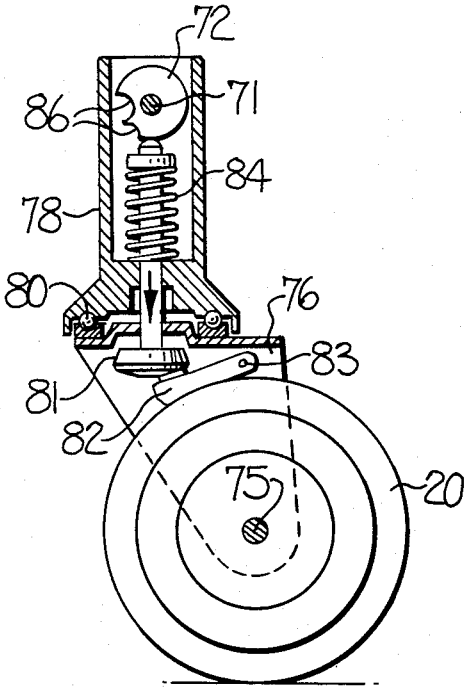
FIG. 6 is a vertical sectional view through the support for one of the caster wheels, showing the manner in which the brake operates to stop rotation of the wheel.

Each caster wheel 20 is supported for rotation on an axle 75 (FIG. 6) which is fixed at opposite ends in the lower ends of a bifurcated wheel support 76. The upper end of the wheel support 76 is mounted to swivel on a vertical control shaft 77 which is supported in a wheel housing 78. The wheel housing 78 is fixed to opposite ends of each of the cross frames 16, 17. A ball bearing 80 is provided between the housing 78 and the wheel support 76 so that the wheel 20 is free to swivel when the control shaft 77 is in a certain position, in a manner to be presently described. The lower end of the control shaft 77 is provided with a brake disc 81 which is adapted to at times engage a brake pad 82 riding on a portion of the wheel 20 and pivotally supported at one end as at 83. A compression spring 84 normally maintains the control shaft 77 in an uppermost position so that the upper end is resiliently urged against the control cam 72. Cam notches 86, of varying depths, are provided in the control cam 72 and are moved into engagement with the upper end of the control shaft 77, depending upon the rotational position of the control cam 72 and the position of the foot operated brake controls 70, 70'.

The position of the foot operated brake controls 70, 70' determines the operating condition of the wheels 20. For example, when the foot operated brake controls 70, 70' are in the horizontal position illustrated in FIGS. 1, 2 and 7, the upper end of the control shaft 77 is in a shallow notch 86 in the control cam 72 and the wheels 20 are free to roll and are free to swivel as the stretcher is moved from one position to another. If it is desired to lock the wheels 20 to cause the stretcher to remain in a stationary position, one of the foot operated brake controls 70, 70' is rocked in a clockwise direction and the corresponding cam 72 is rotated so that the outer surface of the control cam 72 is in engagement with the upper end of the control shaft and the control shaft 77 is lowered to the position shown in FIG. 6 to press the brake pad 82 in engagement with the wheel 20. All wheels 20 remain in locked position as long as the foot operated brake controls 70, 70' remain in the clockwise position.

In order to prevent swivel movement of one wheel 20 at the head end, for steering purposes when transporting the stretcher, one of the foot operated brake controls 70, 70' is rocked in a counterclockwise direction so that the upper end of the control shaft 77 is positioned in the deep cam notch 86 (FIG. 6) in the cam 72 and the spring 84 will raise the control shaft 77 so that the disc 81 engages the horizontal portion of the wheel support 76, thereby preventing swivel movement of the wheel support 76, relative to the housing 78. When the foot operated brake controls 70, 70' are again moved to the horizontal position, the upper end of the control shaft 77 engages the shallow cam notch 86 of the control cam 72 so that the disc 81 is in an intermediate position, out of engagement with the horizontal portion of the wheel support 76 and out of engagement with the brake pad 82. The wheels 20 are then free to roll and the wheel support housing 76 is free to swivel as the stretcher is moved from one position to another.

Figure 4:
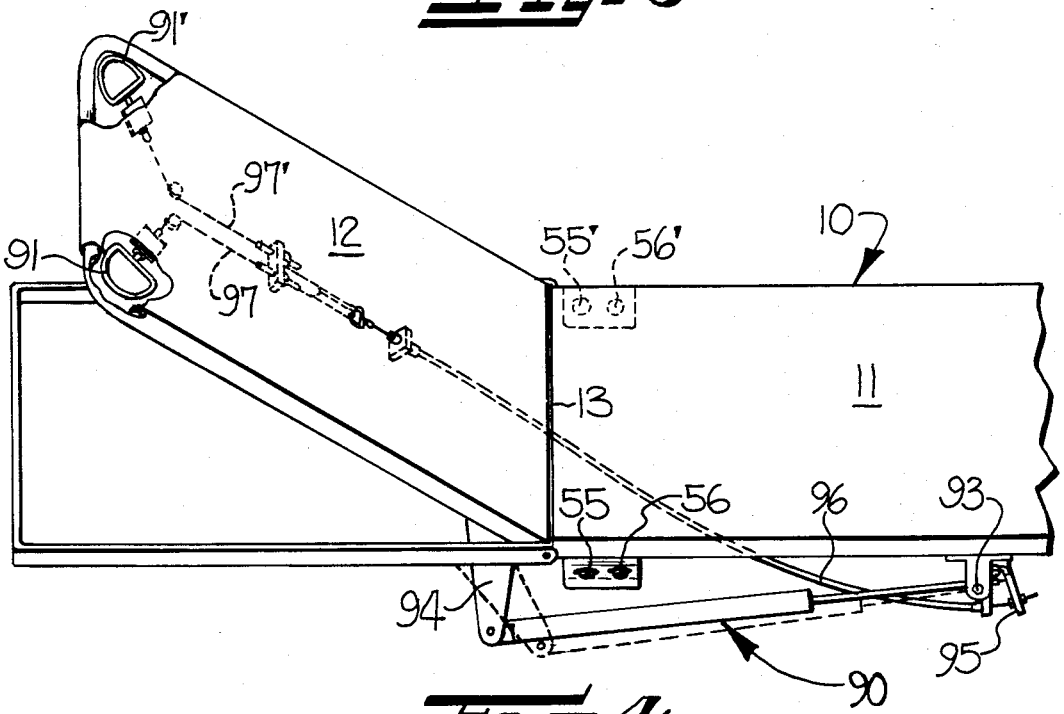
FIG. 4 is a fragmentary and somewhat schematic view of the head end portion of the patient supporting platform and illustrating the manner in which the tilting of the backrest is controlled.

As best shown in FIG. 4, the pivoted backrest 12 is provided with position control means, broadly indicated at 90 and illustrated in the form of a gas spring, for maintaining the backrest 12 in the desired adjusted position and for aiding in moving the backrest 12 from one position to another position. Manually operable control means, in the form of pull handles 91, 91', are positioned at opposite sides of the upper ends of the backrest 12 and are operable to control the gas spring 90. The gas spring 90 is pivotally supported at one end on a support bracket 93 (FIG. 4) fixed to the stationary portion 11 of the patient supporting platform 10. The other end of the gas spring 90 is pivotally connected to the lower end of an operating lever 94, the upper end of which is fixed to the backrest 12. A control lever 95 is supported for pivotal movement on one end of the gas spring 90 and is normally maintained in the neutral position shown in FIG. 4. The control lever 95 may be moved to the activating position (so that the gas spring 90 may be moved) by a main control cable 96. The main control cable 96 is connected to branch control cables 97, 97', which are, in turn, connected to the corresponding pull handles 91, 91'.

When the pull handles 91, 91' are not grasped and pulled, the control lever 95 is in the neutral position so that the gas spring 90 supports the backrest 12 in the adjusted position. When one of the pull handles 91, 91' is grasped and pulled by an attendant at either side of the stretcher, the position of the backrest 12 may be adjusted manually by the attendant and the gas spring 90 will assist the attendant in making the adjustment. When the desired adjustment has been made, the corresponding pull handle 91, 91' is released and the control lever 95 will move to the neutral position and maintain the position of the gas spring 90 and the adjusted position of the backrest 12.

To further aid the attendant in caring for the patient, wire storage utility baskets 100, 100' are supported at opposite sides of the undercarriage 15 and extending along the main frame 18 and between the cross frames 16, 17. These wire storage utility baskets 100, 100' may be used to store medical supplies and the like which may be needed in treatment of the patient and will be readily accessible to an attendant while standing at either side of the stretcher.

The stretcher of the present invention thus includes duplicate adjustment controls positioned on each side of the patient supporting platform so that an attendant may adjust the position of the patient supporting platform without leaving the side of a patient supported on the stretcher. The foot pedals 30, 30' are easily accessible from either side of the stretcher and may be operated by the attendant for raising the position of the patient supporting platform 10. The pushbuttons 55, 55' and 56, 56' are readily accessible by the attendant at either side of the stretcher and may be operated to lower or immediately tilt the patient supporting platform 10 to the Trendlenburg or reverse Trendlenburg positions, as desired. The foot operated brake controls 70, 70' are also positioned at opposite sides of the stretcher for easy access by an attendant standing on either side of the stretcher and are operable to control the conditions of the wheels 20. The pull handles 90, 90' are also positioned at either side of the stretcher so that adjustment of the backrest 12 may be carried out by an attendant positioned at either side of the stretcher. With the stretcher of the present invention, the attendant may remain at either side of the stretcher and still make any necessary adjustments to the position of the stretcher without the necessity of leaving the side of the patient.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A trauma care stretcher including an undercarriage structure including head and foot ends and opposite sides, a wheel supported at each corner of said undercarriage, brake means associated with each of said wheels, a rectangular patient supporting platform, hydraulic means fixed on said undercarriage and supporting said patient supporting platform for vertical movement relative to said undercarriage, said patient supporting platform comprising a fixed body supporting portion and a backrest pivotally connected at one end to said body supporting portion, position control means connected to said backrest and being operable to maintain said backrest in adjusted position and to assist in changing the position of said backrest, said position control means comprises a gas spring fixed at one end to said fixed body supporting portion of said patient supporting platform and operatively connected at the other end to said backrest portion, manually operable means positioned at each side of said backrest for actuating said position control means so that an attendant positioned at either side of said stretcher may vary the adjusted position of said backrest, said manually operable means comprising pull handles at each side of said backrest, said pull handles being operatively connected to said gas spring to permit adjustment of said gas spring when depressed, foot pedal hydraulic pumping means carried by and positioned at each side of said undercarriage for operation by an attendant to raise said patient supporting platform, a foot operated brake control positioned at each side of said undercarriage and being operable by an attendant to apply said brake means to said wheels, control means positioned at each side of said patient supporting platform and being operable by an attendant for lowering and tilting said patient supporting platform, said patient supporting platform lowering and tilting control means comprising pushbutton controls positioned at each side of said patient supporting platform, and valve means operable by said pushbuttons for selectively lowering either of said hydraulic cylinders at said head and foot ends of said undercarriage, said valve means also being operable by said pushbuttons for simultaneously lowering both of said hydraulic cylinders at said head and foot ends of said undercarriage, whereby an attendant at either side of said stretcher may continuously monitor a patient while operating said backrest, said hydraulic pumping means, said brake control, and said patient supporting platform lowering and tilting control means.

2. A trauma care stretcher according to claim 1 wherein said hydraulic means supporting said patient supporting platform comprises hydraulic cylinders positioned adjacent said head and foot ends of said undercarriage.

3. A trauma care stretcher according to claim 2 wherein said foot pedal hydraulic pumping means is operable to simultaneously raise said hydraulic cylinders at said head and foot ends of said undercarriage.

4. A trauma care stretcher according to claim 1 wherein said undercarriage includes a head-end cross frame, a foot-end cross frame, and a central support frame connected at opposite ends to said head-end and foot-end cross frames, and including utility storage baskets on opposite sides of said undercarriage and extending along said central support frame and between said head-end and foot-end cross frames.

* * * * *